United States Patent [19]

Savioli

[11] Patent Number: 4,499,683

[45] Date of Patent: Feb. 19, 1985

[54] AUXILIARY TRIGGER FOR FIREARM

[75] Inventor: Giulio V. Savioli, Andover, N.J.

[73] Assignee: The United States of America as represented by the Secretary of the Army, Washington, D.C.

[21] Appl. No.: 535,499

[22] Filed: Sep. 26, 1983

[51] Int. Cl.[3] ..... F41C 19/00

[52] U.S. Cl. ..... 42/69 R

[58] Field of Search ..... 42/1 Y, 69 R, 69 A, 42/69 B

[56] References Cited

U.S. PATENT DOCUMENTS

| | | | |
|---|---|---|---|
| 672,149 | 4/1901 | Hoehn | 42/69 R |
| 1,000,317 | 8/1911 | Alger | 42/69 R |
| 1,837,093 | 12/1931 | Andrews | 42/69 R |
| 2,589,227 | 3/1952 | Colley | 42/69 R |
| 2,841,908 | 7/1958 | Bourquin | 42/69 R |
| 3,091,878 | 6/1963 | Savioli | 42/69 R |
| 3,964,200 | 6/1976 | Patterson | 42/1 Y |
| 4,276,708 | 7/1981 | Chase | 42/44 |

*Primary Examiner*—Charles T. Jordan
*Assistant Examiner*—Ted L. Parr
*Attorney, Agent, or Firm*—Anthony T. Lane; Robert P. Gibson; Harold H. Card, Jr.

[57] ABSTRACT

A dual function trigger guard has hinged locking and pinned features to enable a firearm when being used in a first mode to be secure against accidental actuation of the trigger and when modified to provide an auxiliary extended trigger which can be efficiently converted to gloved rather than finger operation.

4 Claims, 3 Drawing Figures

AUXILIARY TRIGGER FOR FIREARM

GOVERNMENTAL INTEREST

The invention described herein may be manufactured, used and licensed by or for the Government for governmental purposes without the payment to me of any royalty thereon.

BACKGROUND OF THE INVENTION

The present invention relates to a convertible trigger guard for a firearm which enables a user to fire a weapon either in temperate zones or in the alternative with an extended trigger under arctic conditions where gloves must be worn.

Various means have been used in the past to provide firearms with trigger safety guards to prevent accidental discharge of the weapon. The problem with prior art devices has been that these past trigger safety guard designs have prevented the weapon from being used under prolonged extreme arctic conditions. Because a shooter can not remove his glove or mitten under extreme cold without danger of overexposure and freezing, special weapons were used to meet the specific climatic user requirements. The problem with special purpose prior art arctic firearm designs are that they placed additional logistic supply problems on those forces least able to handle and store extra cargo.

PRIOR ART STATEMENT

A cursory review has been made of class 42 Firearms, subclasses 1Y, 41 and 69R and 70E and no disclosure has been found which the applicant considers pertinent to the present invention. The Auxiliary Firearm Trigger With Integral Safety, U.S. Pat. No. 3,091,878 can be distinguished from the present invention by the difference in structure and function of the trigger guard of the prior art device and the present invention. Prior art trigger guards do not provide for convertible trigger guards which can change to an extended trigger for gloved operation by the simple removal of a pin from one position to the insertion into another position.

SUMMARY OF THE DISCLOSURE

The present device comprises a hinged and pinned auxiliary trigger and safety guard for a firearm. The guard serves a dual function. In a first configuration the guard prevents accidental operation of the trigger. In a second configuration the guard acts as an extended trigger lever permitting the firearm to to be fired with a gloved hand or mitten.

An object of the present invention is to provide an auxiliary trigger for a firearm which requires gloved operation.

Another object of the present invention is to provide a convertible safety guard for a firearm trigger which can serve the dual function of a trigger guard when the ambient condition permits the shooter to fire the weapon using his trigger finger, and to act as an extended trigger when the shooter desires to fire the weapon without using his trigger finger.

A further object of the present invention is to provide selectively collapsible trigger guard which can easily be converted into an extended trigger for gloved operation of a firearm under prolonged arctic conditions.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
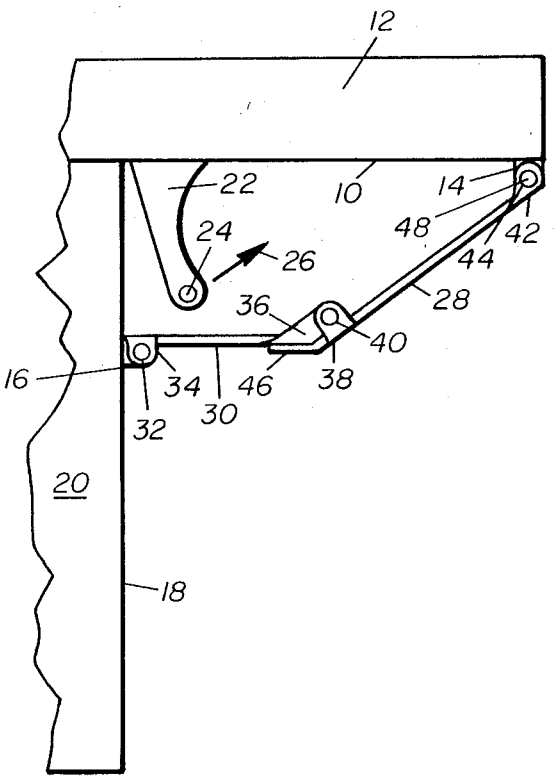
FIG. 1 is a partial plan view of a firearm showing the auxiliary trigger in position as a trigger guard.

Referring now to FIG. 1, the lower side 10 of the firearm muzzle end 12 has a first holed pivot support member 14 fixedly located thereon. A second holed pivot support member 16 is fixedly attached to an inside surface 18 of the firearm handle 20. A trigger 22 having a pin hole 24 therethrough is located in the end thereof. The trigger 22 is spring loaded in the direction of arrow 26. The convertible trigger guard comprises a formed front bar member 28 and a formed rear bar member 30. Rear bar 30 is fixedly hinged to the second support member 16 at first hinge point 32 at its rear end 34 and at its front end 36 to the holed rear end 38 of front bar 28 at second hinge point 40. The holed front end 42 of front bar 28 is removably pinned at hole 44. In this position the trigger guard assembly is prevented from collapsing toward the trigger 22 by an integral shelf +6 located on the rear end 38 of front bar 28 which bears against the front end 36 of rear bar 30.

Figure 2:
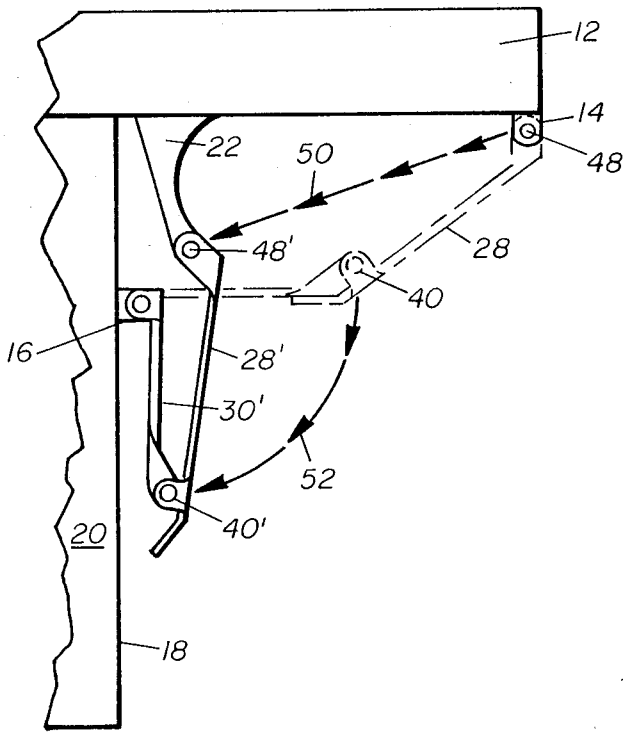
FIG. 2 is a partial plan view of the firearm showing the auxiliary trigger in a ready to use position and in ghost for the position as a trigger guard of FIG. 1.

Referring now to FIG. 2, the auxiliary trigger is prepared for use by removing pin 48 and pivoting the front bar 28 until the hole 44 is in axial alignment with trigger pin hole 24, as shown by direction arrows 50, and inserting pin 48 so that it is in position 48'. The second hinge point 40 is moved to position 40' as shown by direction arrows 52 and front and rear bar members are moved to positions 28' and 30' respectively.

Figure 3:
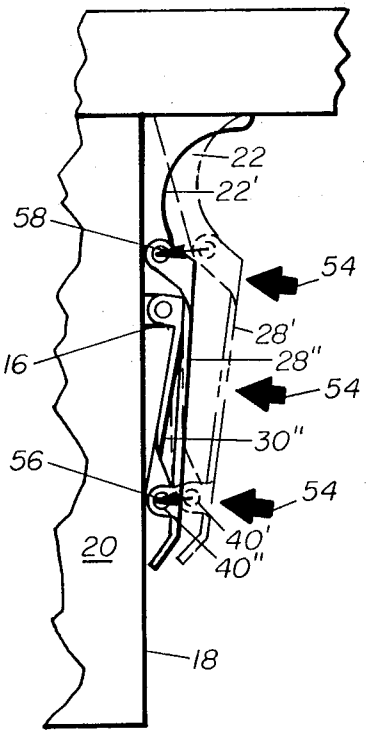
FIG. 3 is a partial plan view of the firearm showing the auxiliary trigger in an actuated position of FIG. 2.

Referring now to FIG. 3, the device is now ready for gloved finger use. Trigger 22 is actuated by applying a load in the direction shown by arrows 54 across the front bar 28' which causes simultaneous deflection of second pivot 40' to point 40'' in the direction of arrow 56. The weapon trigger 22 moves to the fire position 22' in the direction shown by arrows 58 when front and rear bar members 28' and 30' respectively are moved to the fire position shown by front and rear bar members 28'' and 30''. Upon release of the load the trigger 22', the front bar 22' and rear bar 30'' will return to the ready to use position shown in FIG. 2 because of the spring biasing force 26 aforementioned on the trigger.

While there has been described and illustrated specific embodiments of the invention, it will be obvious that various changes, modifications and additions can be made herein without departing from the field of the invention which should be limited only by the scope of the appended claims.

What is claimed is:

1. An auxiliary trigger for a firearm which comprises:

a biased trigger having a trigger pin hole in one end thereof;

a first holed pivot support member operatively positioned on a lower side of the muzzle end of said firearm;

a second holed pivot support member operatively disposed and fixedly attached to an inside surface of the handle of said firearm;

convertible trigger guard means detachably connected to said first holed pivot support member by removeable pin means on a front end and hingedly connected to said second holed pivot support member, said guard means acting as a conventional trigger guard to prevent accidental firing then said front end is pin connected to said first support member, and for acting as an auxiliary extended trigger for gloved operation when said trigger guard front end is pivotally connected to said end of said biased trigger by means of insertion of a pin through said trigger pin hole.

2. An auxiliary trigger as recited in claim 1 wherein said convertible trigger guard means includes a formed front bar member having a holed front end removeably connected to said first pivot support member, means for preventing said front bar from collapsing toward said trigger, and a hinge point operatively positioned adjacent said means for preventing said front bar from collapsing.

3. An auxiliary trigger as recited in claim 2 wherein said convertible trigger guard means includes a formed rear bar member having a front end hingedly connected to said rear end of said front bar, and a rear end hingedly connectected to said second pivot support member.

4. An auxiliary trigger as recited in claim 3 wherein said means for preventing said front bar from collapsing includes a front bar having a shelf on the rear end of said front bar, said shelf contacting said front end of said rear bar.

* * * * *